US007575013B2

(12) United States Patent
Bergman

(10) Patent No.: US 7,575,013 B2
(45) Date of Patent: Aug. 18, 2009

(54) METHOD AND ARRANGEMENT IN THE MANUFACTURE OF COATING

(75) Inventor: John Bergman, Turku (FI)

(73) Assignee: Metso Paper, Inc., Helsinki (FI)

( * ) Notice: Subject to any disclaimer, the term of this patent is extended or adjusted under 35 U.S.C. 154(b) by 769 days.

(21) Appl. No.: 10/531,537

(22) PCT Filed: Oct. 16, 2003

(86) PCT No.: PCT/FI03/00766

§ 371 (c)(1),
(2), (4) Date: Apr. 15, 2005

(87) PCT Pub. No.: WO2004/035928

PCT Pub. Date: Apr. 29, 2004

(65) Prior Publication Data

US 2006/0081287 A1 Apr. 20, 2006

(30) Foreign Application Priority Data

Oct. 17, 2002 (FI) ..... 20021859
Oct. 18, 2002 (FI) ..... 20021866

(51) Int. Cl.
*E03B 1/00* (2006.01)

(52) U.S. Cl. ..... 137/3; 427/361; 427/365; 427/382; 422/129; 366/160

(58) Field of Classification Search ..... 137/3; 427/361
See application file for complete search history.

(56) References Cited

U.S. PATENT DOCUMENTS

| | | | | |
|---|---|---|---|---|
| 4,987,852 | A * | 1/1991 | Sakai et al. | 118/603 |
| 5,935,332 | A | 8/1999 | Caucal | |
| 6,190,619 | B1 * | 2/2001 | Kilcoin et al. | 506/33 |
| 6,230,550 | B1 | 5/2001 | Bergman et al. | |
| 6,485,692 | B1 * | 11/2002 | Freitag et al. | 422/130 |
| 7,344,297 | B2 * | 3/2008 | Urquhart | 366/132 |
| 2002/0154567 | A1 * | 10/2002 | Husher | 366/132 |
| 2003/0161763 | A1 * | 8/2003 | Erden et al. | 422/99 |
| 2004/0106716 | A1 | 6/2004 | Becker et al. | |
| 2004/0144164 | A1 | 7/2004 | Bergman | |

FOREIGN PATENT DOCUMENTS

| | | | |
|---|---|---|---|
| EP | 0 535 321 | A1 | 4/1993 |
| EP | 0 605 137 | A1 | 7/1994 |
| EP | 0 916 765 | A1 | 5/1999 |
| EP | 1 346 761 | A2 | 9/2003 |
| WO | WO 02/066739 | A1 | 8/2002 |
| WO | WO 2004/035928 | A1 | 4/2004 |

OTHER PUBLICATIONS

International Preliminary Examination Report issued in PCT/FI2003/000766.
International Search Report issued in PCT/FI2003/000766.

* cited by examiner

*Primary Examiner*—Jerry Lorengo
*Assistant Examiner*—Yun Qian
(74) *Attorney, Agent, or Firm*—Stiennon & Stiennon

(57) ABSTRACT

Coating is manufactured by mixing two or more components together in two or more mixing zones arranged in series and/or in parallel, of which at least some are pressurized.

14 Claims, 3 Drawing Sheets

METHOD AND ARRANGEMENT IN THE MANUFACTURE OF COATING

CROSS REFERENCES TO RELATED APPLICATIONS

This application is a U.S. national stage application of international App. No. PCT/FI2003/000766, filed Oct. 16, 2003, the disclosure of which is incorporated by reference herein, and claims priority on Finnish App. No. 20021859, filed Oct. 17, 2002, and Finnish App. No. 20021866, filed Oct. 18, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

Coatings, such as for example, coatings used in paper and board manufacturing, are known to be mainly manufactured in batches in mixing containers. In addition, continuously operated manufacturing processes are known. In both principles, the operation principle is that coating components i.e. raw materials, are dosed to the mixing container, in which container they are mixed to form a prepared coating.

The problem with known and typical batch operated manufacturing processes is, that to change the type of coating requires several containers and hours of preparation. Thus the space requirement of the batch operated manufacturing processes is large. In addition, when washing a batch operated process, a lot of water that contains coating will be produced, and its further treatment can in some circumstances be cumbersome.

The problem with known typical continuous processes is their limited scope in handling recipes compared to batch processes. In addition, the requirements for reproducibility and accuracy of component dosing increase the costs of a continuous arrangement.

In addition, the problem with known coating manufacturing processes is their tendency, to some extent, to mix air into the coating. For example, in curtain coating, the air content of the coating can be at the highest 0-0.25 percent by volume. Otherwise the air bound to the coating may cause uncoated patches in the material to be coated, for example, paper or board. In a multi layer curtain coating the significance of deaeration is still increased. Then, if there are for example three or four layers of coating, the coating used when forming each layer must be deaerated, at least to remove free air bubbles, before coating.

In known arrangements, several methods have been tried to remove the air from the coating. Deaeration of the prepared coating is mainly based on the use of centrifugal force i.e. in practice the use of hydrocyclones. The coating is fed to the hydrocyclones under a relatively high pressure, the pressure being typically 1-4 bar. In the cyclones described, the area of pressure difference is approximately 1-2 bar in practice. When the coating is under such pressure, air is dissolved into the coating, more specifically into the liquid used in the coating manufacture, such as water. Therefore, with a centrifugal air-separator, only free air in the coating can be removed, which in addition, diminishes when the pressure rises. When the pressure affecting the coating is again reduced, for example, at the coating station, the air dissolved in the coating is released and expands due to the change in pressure, thus causing problems in the operation of the coating station.

In addition, in Patent Application Publication WO 02/066739 a paste manufacturing method is disclosed, where the paste is manufactured by mixing the pigments and binder (latex) together in an open mixer, from which the mixture produced is led to the deaeration. Because in the solution disclosed in the cited publication the deaeration is done by spraying the pigment binder mixture in one or two stages, then according to the publication, the viscosity of the mixture must be under 500 mPas (Brookfield 100 RPM 20° C.), and preferably under 200 mPas. After the deaeration, a surface active agent and thickener is added in a closed space to the pigment and binder mixture. The publication discloses that the pressure in the deaeration chamber is approximately 0.05 bar. The problem with the deaeration method disclosed in the publication is that it is not suitable for pastes and mixtures having a viscosity too high for deaeration by spraying. Therefore, the method disclosed in the publication requires a separate storage container, into which the prepared paste can be fed when it cannot, for example, during a malfunction, be fed directly to the coating station because due to the high viscosity of the paste, it probably cannot be led back to the open mixer.

SUMMARY OF THE INVENTION

The object of the method and arrangement according to the present invention is to eliminate or at least significantly reduce the problems arising from the aforementioned prior art, and to disclose a method and arrangement in the manufacture of coating, with the help of which the quality of the prepared coating can be controlled and managed better than before.

In addition, the object of the method and arrangement according to the present invention is to enable the controllability of the mixing order of the coating components and the mixing intensity of different types of components.

Furthermore, the object of the method and arrangement according to the present invention is to disclose a method and arrangement in the manufacture of coating, with which the amount of dissolved and free air in the coating can be reduced.

In a typical method according to the invention, the mixing of components is carried out by mixing two or more components in two or more mixing zones arranged in series and/or in parallel, of which at least some are pressurized. This kind of use of several, more preferably consecutive, mixing zones i.e. a so-called cascade process, makes it possible to combine the advantages of batch and continuous operation process. In addition, research results proving that the order of dosing the components affects the properties of the treatment agent can be utilized. In a method according to the present invention, the components can be mixed in pairs or several components at once. In addition, the components can be chosen in such a way, that they do not produce any harmful chemical or physico-chemical reactions with each other.

In a method according to the present invention, the pressure level in the mixing zone is typically approximately 100-1000 kPa and preferably approximately 200-500 kPa. An increase of the pressure level in the mixing zone makes it possible to increase the energy used in the mixing i.e. increasing the intensity of the mixing. More preferably, the components to be mixed are in a pressurized space also at least between the pressurized mixing zones. More preferably the components to be mixed are mixed in such a way that the mixing arrangement used is pressurized, i.e. the arrangement is closed from any air sources outside the arrangement and/or air outlets from component feeding pumps to the machine container. Then the conditions of the mixing process can be carefully controlled and the mixing of the excess air, impeding the properties of the mixture, into the mixture is prevented.

If the components to be mixed include a lot of air, it is preferable that at least some of such components are led to the mixing zone through a deaeration means, such as a centrifugal air-separator. Thus the amount of air carried into the mixture along the components can be reduced and in this way the quality and usability of the formed mixture improved.

In a preferred method according to the present invention, the temperature of the coating to be manufactured is controlled with a temperature control system arranged in connection with one or more mixing zones. Thus the properties of the coating can be controlled and the temperature of the coating can be set as desired. Typically the temperature of the prepared coating after the last mixing zone is about 15-65° C.

In a preferred method according to the present invention the coating manufactured in the mixing zones is led to a pressure screen. By using the pressure screen possible unwanted particles included in the coating can be removed. During the screening, possible air bubbles mixed in the coating are also broken when moving through the screen and exit through the screen deaeration outlet. In the method according to the present invention, more than one pressure screen can be used. From the pressure screen, the coating is led to the machine container. According to one more preferred method according to the present invention, a pressure lower than the atmospheric pressure is arranged in the machine container, so that the pressure in the machine container is approximately 5-105 kPa.

In a preferable method according to the present invention, the components mixed in one or more mixing zones are fed to a separator, in which an under pressure of approximately 0.5-50 kPa and preferably approximately 2-15 kPa is arranged. Then in the separator according to the present invention, a lower absolute pressure is present than in traditional centrifugal air-separators, so that the air dissolved in the coating is released and can be removed in the separator using centrifugal force and an under pressure. The feeding pressure of the coating when the coating is fed to the deaerator can be between 10-300 kPa. The coating containing very little air and located in the separator is preferably led to the coating station. In addition, the amount of the mixture i.e. coating being fed to one or more coating stations can be measured and thus accurately control the coating process.

According to one preferred present method, the properties of the mixture of the mixed components are measured with one or more measurement devices arranged after at least one mixing zone. Thus the measurements can be done from the prepared coating or mixture of its components. On the basis of the result of the measurement made, the ratio and/or amount of components being fed to the coating being manufactured can be controlled in different mixing zones.

In a typical arrangement according to the present invention, the means for mixing the components are arranged to two or more serial and/or parallel mixing zones, of which at least some are pressurized. To feed components to the mixing zone, for example, pumps, gravitational force, shutter feeders or other suitable devices can be used. In the mixing zones, for example, static mixers, mixer pumps, mixer tanks or other suitable process devices can function as mixers.

In one preferred arrangement according to the present invention, in the mixing zone is arranged a pressure level, which typically is approximately 100-1000 kPa and preferably approximately 200-500 kPa. Typically, in different mixing zones, there are different pressure levels, but they can also be equal. Components being mixed in the mixing zone and the flow speed used affect the pressure level which is used in a mixing zone. The pressure level can be measured and/or monitored for example with a pressure transmitter. The controlling of a mixing zone can be arranged in this case for example in such a way, that a standardized mixing effect is used in a mixing zone and the mixing conditions are changed, for example, by adjusting the flow speed. The arrangement is more preferably also pressurized between the mixing zones, whereby the arrangement is preferably pressurized from the raw material feeding pumps all the way to the machine container.

In one preferred arrangement according to the present invention, the arrangement comprises means for removing and/or reducing air from one or more components being fed to a mixing zone. Thus the amount of air being transferred to the mixture with the components can be reduced, whereupon the amount of air also in the prepared mixture is reduced.

One preferred arrangement according to the present invention comprises means for removing air from the mixture, which means comprise a separator, where an under pressure is arranged, which is approximately 0.5-50 kPa and preferably approximately 2-15 kPa. More preferably, the means for removing air from the mixture comprise in addition a centrifugal air-separator, which is arranged between the mixing zone and the separator. Using the said means, the dissolved and free air in the coating can be almost totally removed i.e. typically to under 1 percent by volume, preferably under 0.5 percent by volume.

One preferred arrangement according to the present invention comprises at least one temperature control system for controlling the temperature of the coating being mixed in the mixer arranged in connection to at least one mixer comprised in the mixing zone. More preferably, the temperature control system is an integral part of the mixer. With the temperature control system the coating can be heated or cooled so that the desired temperature is reached, typically 15-65° C. When the temperature control system is arranged in connection with the mixer, there is no need for a separate temperature control system, which among other things, would increase the space needed for the arrangement.

One preferred arrangement according to the present invention comprises at least one pressure screen for screening the mixture at least after one mixing zone. More preferably the pressure screen is a perforated, slotted or oval screen. The perforation size for the substance screen to be used with the arrangement is preferably approximately 65-300 micrometers. With the pressure screen the possible unwanted particles included in the coating can be removed. In addition to the pressure screen, a deaeration line is very preferably arranged, which is connected to the machine container at the other end. Through the deaeration line, the air being released when the possible air bubbles in the coating are broken in the screen, can be removed.

An arrangement according to the present invention also comprises preferably means for transferring the mixture from the separator and/or pressure screen to one or more coating stations. More preferably, the arrangement also comprises means for measuring the amount of the mixture being transferred to one or more coating stations. For measuring the amount of mixture, for example, a mass flow and/or a volume flow meter can be used depending on the application.

One preferred arrangement according to the present invention comprises means and/or the arrangement is connected to means for measuring the properties of the mixture formed from mixed components. More preferably, the means for measuring the properties of the mixture formed from mixed components comprise at least one or more measuring devices arranged after at least one mixing zone. With the measuring devices, the feeding of components to the mixing zones can be controlled.

One of the greatest advantages of the method and arrangement according to the present invention is that the properties and quality of the coating formed as an end-product can be well controlled, because the method and arrangement can be carefully controlled. Thus with the help of the method and the arrangement according to the present invention the properties of the coating can be maintained more stable than before, whereupon the runnability of the coating station is improved and interruptions caused by the coating are reduced. In addition, the measurement according to the preferred embodiment enables the measurement and control of the recipe and physical properties of the coating with a very short delay.

In addition, an advantage of the present invention is that the mixing order of the components is controllable and the mixing intensity is controllable with different types of mixing zones.

In addition, an advantage of one preferred embodiment of the method and arrangement according to the present invention is, that the dissolved and already free air in the coating can be removed more effectively than in known systems. In addition, the wastage of coating will remain at the same level or even lower than before.

In the following, the invention is described with reference to the appended drawings.

DESCRIPTION OF THE PREFERRED EMBODIMENTS

Figure 1:
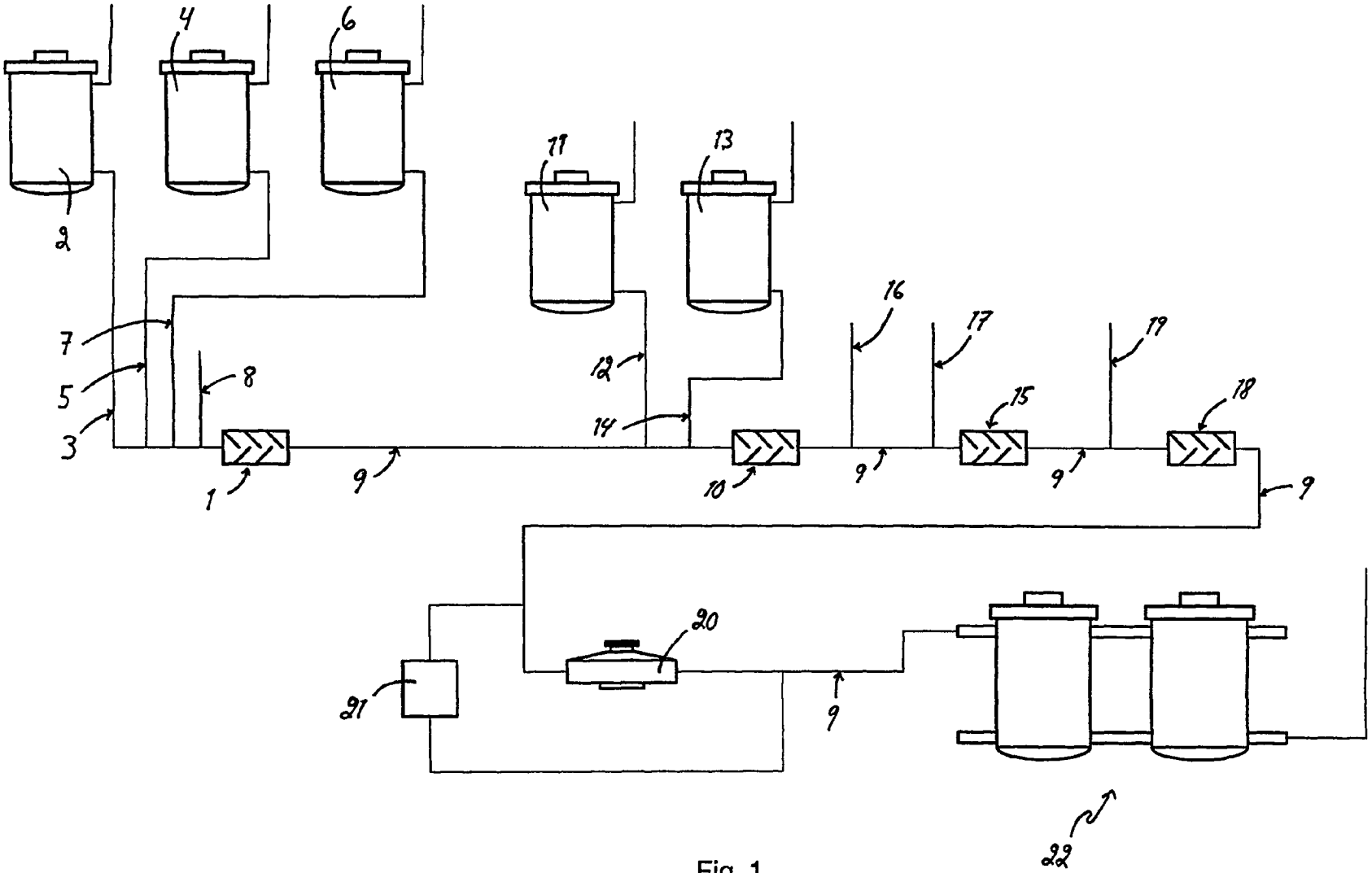
FIG. 1 schematically illustrates a flow chart for making coating according to the invention.

FIG. 1 schematically illustrates, by way of an example, a process flow chart for making the coating. As the figure illustrates, the manufacturing process comprises a number of mixing zones, where the components to be mixed are directly led, for example, from storage containers or through a screen.

The first mixing zone contains a static mixer 1, which is under 20-500 kPa pressure. A first pigment, such as calcium carbonate, is led along a pipeline 3 through a first screen 2 to the mixer 1. In addition, a second pigment, such as calcium carbonate is led along a pipeline 5 through a second screen 4 to the mixer 1. Furthermore, to the mixer, a binder such as latex, is led along a pipeline 7 through a third screen 6, and a dispersing agent along a pipeline 8. From the first mixing zone, the mixture is led, under pressure, along a pipeline 9 to a second mixing zone, where a third pigment, such as kaolin, is added to the mixture before a mixer 10 along a pipeline 12 through a screen 11, and along a pipeline 14 through a screen 13 a fourth pigment, such as kaolin, is added. Pumps can be used to transfer the mixture between the mixing zones, but it can also be performed without pumps. Also the second mixer 10 is a static mixer, which is under pressure of approximately 200-500 kPa. A dynamic mixer can be used instead of a static mixer.

From the second mixing zone, the mixture is led under pressure along a pipeline to a third mixing zone.

In the third mixing zone, before a mixer 15, CMC (carboxy-methyl cellulose) is added to the mixture along a pipeline 16, and optical brightening agent along a pipeline 17. The third mixer 15 is a static mixer, which is under pressure of approximately 200-500 kPa. As a third mixer, a dynamic mixer can also, in some applications, be used instead.

From the third mixing zone, the mixture is transferred, under pressure, to a fourth mixing zone, which comprises a fourth static mixer 18, which can also be replaced with a dynamic mixer. In the fourth mixing zone, water can be added to the mixture along a pipeline 19. The fourth mixer is under pressure of approximately 200-500 kPa. To the fourth mixer 18, means for controlling the temperature, i.e. for heating and/or cooling the mixture being transported through the mixer, have been connected. The means for temperature control have been realized by arranging water circulation to the mixer and means for heating and/or cooling the water circulating in the water circulation.

The mixture, which has passed through the fourth mixing zone, is led to a continuous mixer/dispergator device 20 (rotor/stator based) and the first actual quality measurement is made, where one or more of the following factors are measured from the mixture: dry matter content, pH, viscosity, chemical composition, temperature, density and air content. The measurement can be performed, for example, by using the method and arrangement described in Metso Paper, Inc.'s Finnish patent application FI 20010818 or the method and arrangement described in Metso Paper, Inc.'s U.S. Pat. No. 6,230,550. In FIG. 1 the reference number 21 illustrates the arrangement described in US-patent publication U.S. Pat. No. 6,230,550 and its connection to the coating manufacturing process.

The results of the quality measurement can be used to control the amount of components fed, their feeding ratios and feeding speed, and for controlling the process conditions of the mixing zones, such as for example the pressure prevailing in the mixing zone. In addition, in the method and arrangement according to the invention, more quality measurements can be used than the measurement illustrated in the figure. The number and location of the quality measurements are defined according to the respective measurement and usage needs. Thus the arrangement can also comprise measurements between different mixing zones. In that case the measurements can be carried out, for example, in such a way that the first quality measurement is performed after the second mixing zone, when measured parameters could be, for example, the dry matter content, pH, viscosity, chemical composition, temperature, density and air content of the mixture. Thus in the third mixing zone, for example the dry matter content and viscosity can be adjusted according to the first quality measurement. The second quality measurement could be located after the third mixing zone, when measured parameters could be, for example, the dry matter content, temperature and density of the mixture. The method and arrangement according to the present invention can also be carried out in such a way, that the properties of the prepared coating are measured from a surface of coated material web, for example, using reflection measurement and this result is used alone or together with other measurements to control and/or adjust the manufacturing of the coating paste to be manufactured.

Figure 2:
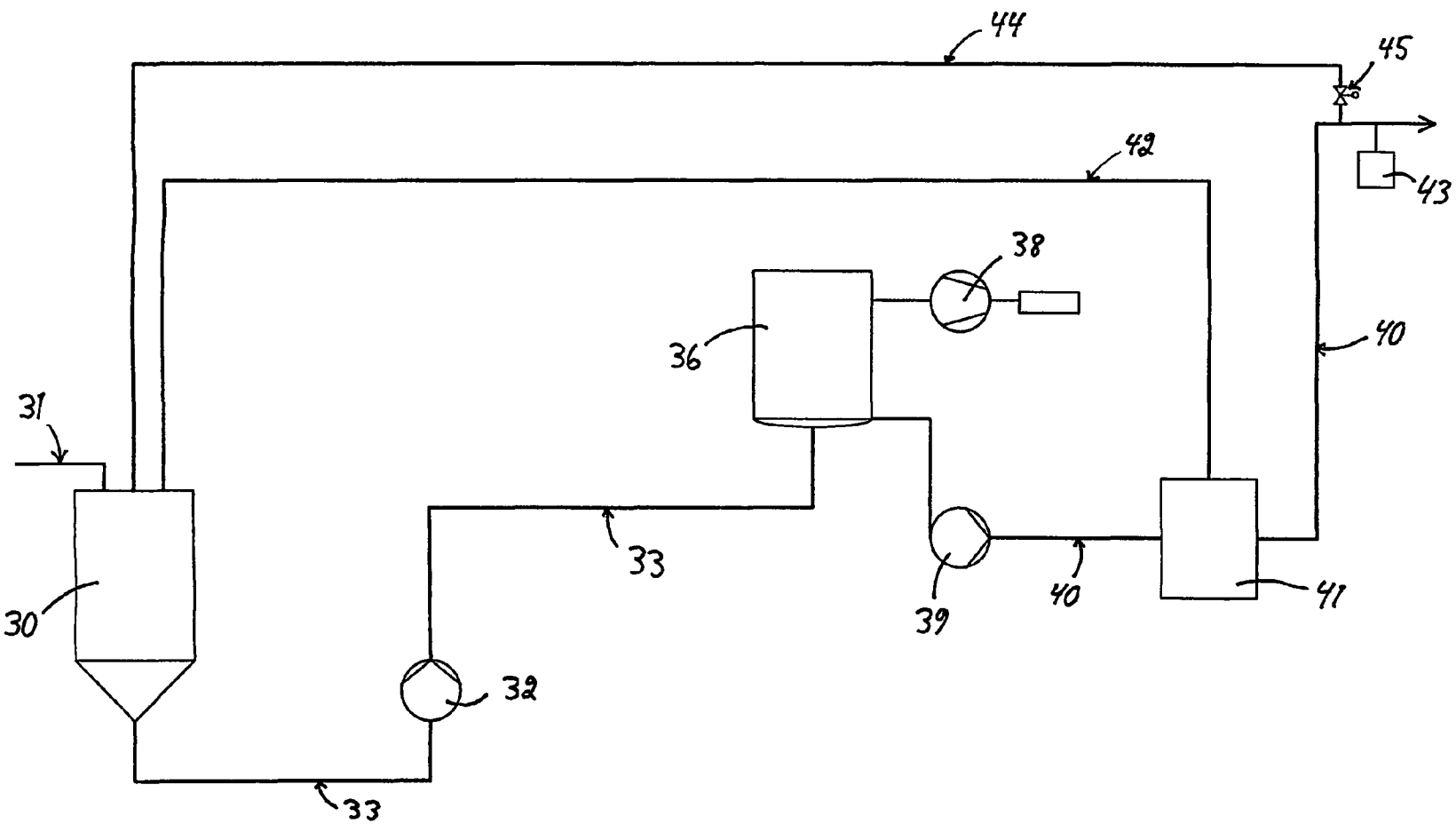
FIG. 2 schematically illustrates a deaeration arrangement according to the invention.

From the mixer/dispergator device 20 the coating mixture is led through a group of screens 22 to the coating station, for example, to a curtain coating station, or for deaeration, illustrated in FIG. 2. The group of screens 22 comprises two pressure screens, which comprise a perforated screen, whose perforation size can be approximately 65-300 micrometers, depending on the application. As a screen, also only one screen or more than two screens can be used. In addition, for example, a slotted or oval screen can be used.

Figure 3:
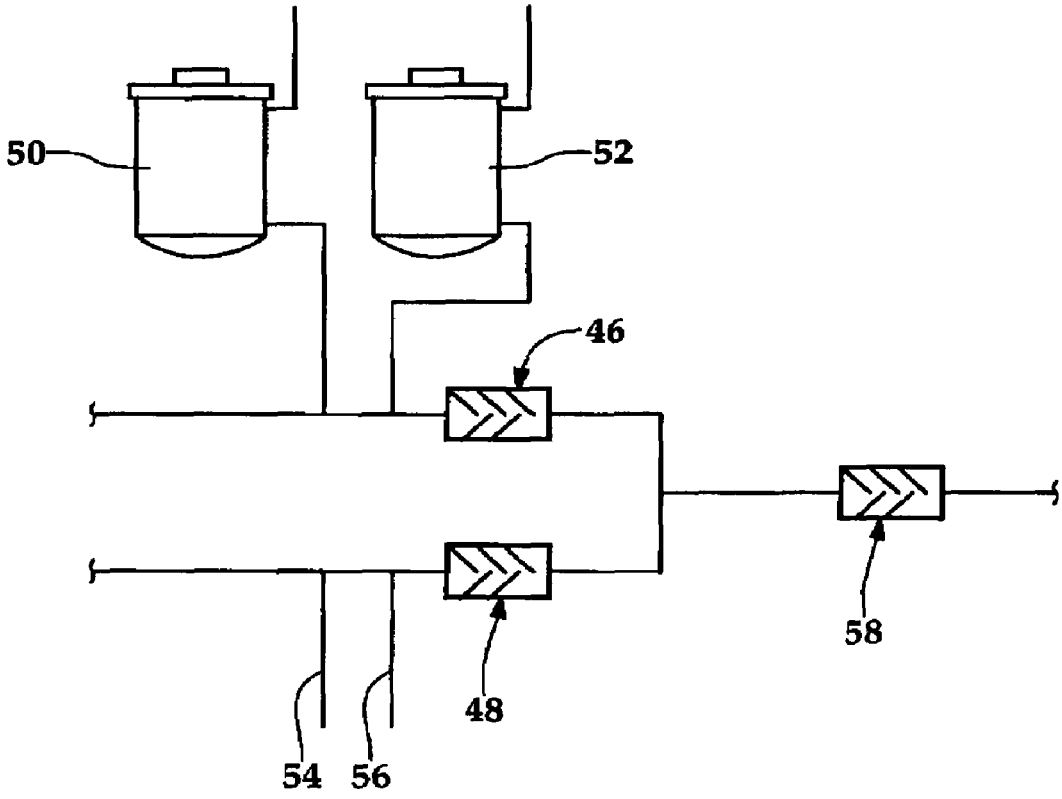
FIG. 3 is a fragmentary schematic illustration of a portion of a flow chart for making coating according to this invention, with some mixing zones parallel.

In FIG. 1 the mixing zones are illustrated as connected in series. As shown in FIG. 3, the mixing zones 46, 48 can also be arranged in such a way, that some mixing zones are parallel, such that parallel mixing zones can be used to mix components 50, 52, 54, 56, which separate mixtures are then at a later stage, i.e. in a mixing zone 58 serial to the aforementioned, mixed together.

In addition, the arrangement can have both fewer or more mixing zones than illustrated in FIG. 1. Also, the components to be mixed and their order of mixing can vary.

As mentioned above, compounds which form the mixture and which are mixed to it, i.e. the raw materials of the coating, are led to the screens and/or to the mixing, typically from the storage containers with feeding pumps. The components to be mixed can also be brought, for example, from silos or mill circulation lines. In addition, deaeration means can be connected to the arrangement for one or more compounds to be mixed, whereby the air content of the compound to be mixed can be reduced and thus decrease the amount of air carried into the mixture. The deaeration means can, in that case, be located, for example, between the screen and a mixing zone or before the screen. If the compound to be mixed does not need to be screened, the deaeration can be arranged to the pipeline, for example, just before the pipeline connects to the mixing zone.

In FIG. 1 is not shown, in order to simplify the figure, valves or their control devices or other per se essential but, for the person skilled in the art, obvious parts of the arrangement, such as for example different pressure and flow sensors in the pipelines, component return lines and washing systems.

FIG. 2 schematically and by way of an example shows a deaeration arrangement according to the present invention. As shown in the figure, for example, in an arrangement according to FIG. 1, the coating is led to a machine container 30 along a pipeline 31. A deaeration arrangement according to FIG. 2, can also be connected to other types of arrangements for coating manufacture, than shown in FIG. 1.

Means for adjusting the pressure in the machine container is connected to the machine container, whereby a pressure lower than normal atmospheric pressure can be arranged in the machine container 30 if needed. Thus, the pressure in the machine container can be 5-105 kPa. The machine container 30 comprises in addition a mixer, with which the coating fed to the container can be mixed. From the machine container 30, the coating is transferred by a pump 32, such as an eccentric screw pump, along a pipeline 33 to an underpressure deaerator 36. The pressure of the coating in the pipeline 33 is typically approximately 10-300 kPa. In the underpressure deaerator 36 the air possibly contained in the coating is removed, i.e. the air dissolved in the coating and any free remaining air. The prevailing vacuum in the underpressure deaerator 36, of approximately 0.5-50 kPa and preferably approximately 2-15 kPa, is accomplished by a pump 38, such as a compressor or vacuum pump, connected to the underpressure deaerator 36. After the underpressure, deaerator 36, the air content of the coating is in practice almost zero, i.e. under 0.1 percent by volume and the pressure on the inlet side of a pressure pump 39, is approximately 20-40 kPa. From the underpressure deaerator 36, the coating is pumped by the pump 39 along a pipeline 40 to the coating station, and after the pumping the pressure of the coating is approximately 100-1000 kPa depending on the application and type of the coating station. At the coating station one or both sides of the web, such as a paper or board web, are coated simultaneously. The coating layer can be composed of one or more layers, depending on the need and application. If coatings with different chemical compositions are used for different layers, each different coating typically needs its own feeding, deaeration etc. arrangements.

A pressure screen 41 is arranged, to a pipeline 40, after the above described deaeration arrangement, which pressure screen ensures that no unwanted particles are carried to the coating station. A deaeration line 42 of the pressure screen 41 is connected to the machine container 30. The pressure screen can, for example, be of similar type to the one illustrated in FIG. 1.

FIG. 2, in addition, illustrates a connection of a measurement system 43 to the pipeline 40 for measuring properties of the mixture i.e. coating transported through the pipeline 40. The measuring system may comprise, for example, means for the measuring gas content, density, dry matter content, viscosity, pH and/or bubble size of the coating. At least some of the said measurements can be performed using the method and arrangement described in the Metso Paper, Inc.'s patent application FI 20010818 or the method and arrangement described in the Metso Paper, Inc.'s U.S. Pat. No. 6,230,550.

FIG. 2, in addition, illustrates a return line 44 connected to the pipeline 40, which is equipped with a valve 45. The second end of the return line 44 is connected to the machine container 30. If the coating process is temporarily interrupted, the deaeration can be continued in the machine circulation independent of coating, because with the return line 44, the coating can be returned to the machine container 30. Thus, it is ensured that when the coating is restarted, there is gas free coating material available again. In addition, if the measurement system 43 comprises mass flow measurement of the coating, the amount of coating being transported to the coating station can be controlled and managed with the valve 45. Thus, especially when using multi-layer coating, the amount of coating used for each layer can be carefully controlled as desired.

With the manufacture and the deaeration arrangement of the coating according to the present invention, coating can be manufactured the gas content of which after the deaeration arrangement is typically approximately 0-0.1 percent by volume, surface tension is typically approximately 10-150 mN/m, dry matter content is typically approximately 50-75 percent by weight and temperature is typically approximately 15-65° C. The viscosity of the coating is typically approximately 5-700 mPas (ColorMat) i.e. the viscosity measurement has been performed using an on-line measuring, in which the viscosity measurement is based on the use of several shear force values.

It is not intended to limit, in any way, the invention to the above embodiments, but it can be varied within the scope of the inventive idea described in the claims.

The invention claimed is:

1. A method for the manufacture of a coating for a paper or board web, comprising the steps of:

mixing at least two components in a first mixing zone and mixing at least two components in a second mixing zone wherein the first mixing zone and the second mixing zone are in parallel, or mixing at least one component in a second mixing zone with the mixture of the at least two components wherein the first mixing zone and the second mixing zone are in series, wherein at least one of the first mixing zone and the second mixing zone is pressurized at a pressure level about 200 to 1,000 kPa, to thereby form a paper or board web coating;

wherein the paper or board web coating is fed to a pressure screen;

from the pressure screen the paper or board web coating is further led to a machine container; and from the machine container said paper or board web coating is fed to a coating station and used to form a coating on a paper or board web.

2. The method of claim 1 wherein the pressure level is about 200-500 kPa.

3. The method of claim 1 wherein the components mixed are in a pressurized space also at least between the pressurized mixing zones.

4. The method of claim 3 wherein components are supplied to the first mixing zone and the second mixing zone from component feeding pumps, and wherein the mixed components are supplied to the machine container, and wherein a mixing arrangement is used, which is pressurized from the component feeding pumps to the machine container.

5. The method of claim 1 wherein at least one of the components to be mixed is led to one of the mixing zones through a deaeration means.

6. The method of claim 1 wherein the temperature of the coating is controlled with a temperature control system arranged in connection with one or more mixing zones.

7. The method of claim 1 wherein the components mixed in the first mixing zone or the second mixing zone are fed to a separator, into which an underpressure of approximately 0.5-50 kPa is applied.

8. The method of claim 7 wherein the underpressure in the separator is approximately 2-15 kPa.

9. The method of claim 1 wherein the properties of the paper or board web coating are measured with at least one measurement device arranged after the first mixing zone or the second mixing zone.

10. An apparatus for the manufacture of a paper or board web coating from coating components, the apparatus comprising:

a first static mixer with a first mixing zone therein;

a first conduit communicating from a first pressure screen to the first mixing zone and transporting thereto a first pigment;

a second conduit communicating from a second pressure screen to the first mixing zone and transporting thereto a second pigment, for mixing therein with the first pigment to define a first mixture;

a second static mixer with a second mixing zone therein, the second mixer communicating in series with the first mixer to receive the first mixture therefrom;

a third conduit communicating from a third pressure screen to the second mixing zone and transporting thereto a third pigment for mixture with the first pigment and the second pigment therein to define a second mixture which is a coating, wherein at least one of the first mixing zone and the second mixing zone are connected to a source of pressure of approximately 200-1000 kPa;

a pressure screen in coating receiving relation to said second mixer;

a machine container in coating receiving relation to said pressure screen; and a coating station in coating receiving relation to the machine container.

11. An apparatus for the manufacture of a paper or board web coating from coating components, the apparatus comprising:

a first static mixer with a first mixing zone therein;

a first conduit communicating from a first pressure screen to the first mixing zone and transporting thereto a first pigment;

a second conduit communicating from a second pressure screen to the first mixing zone and transporting thereto a second pigment, for mixing therein with the first pigment to define a first mixture;

a second static mixer with a second mixing zone therein;

a third conduit communicating from a third pressure screen to the second mixing zone and transporting thereto a third coating component;

a fourth conduit communicating from a fourth pressure screen to the second mixing zone and transporting thereto a fourth coating component for mixture therein with the third coating component to define a second mixture; and a conduit extending from the first static mixer and the second static mixer which are arranged in parallel, and communicating with a third static mixer, to combine the first mixture and the second mixture within a third mixing zone within the third static mixer to form a coating, wherein at least some of the first mixing zone, the second mixing zone, and the third mixing zone are connected to a source of pressure of a pressure level of approximately 200-1000 kPa;

a pressure screen in coating receiving relation to said second static mixer;

a machine container in coating receiving relation to said pressure screen; and a coating station in coating receiving relation to the machine container.

12. A method for the manufacture of a coating for a paper or board web, comprising the steps of:

passing a first pigment through a first pressure screen to a first pipe which flows into a first static mixer;

passing a second pigment through a second pressure screen to the first pipe which flows into the first static mixer;

passing a binder through a third pressure screen to the first pipe which flows into the first static mixer, wherein the first pigment, the second pigment and the binder are mixed in the first static mixer at a pressure level of 200 to 1,000 kPa, and form a first mixture which is supplied to a second pipe which flows into a second static mixer;

passing a third pigment through a fourth pressure screen to the second pipe which flows into the second static mixer;

wherein the third pigment and the first mixture are mixed in the second static mixer at a pressure level of 200 to 1,000 kPa to form a second mixture which is supplied to a third pipe which flows into a third static mixer;

supplying an optical brightening agent to the third pipe which flows into the third static mixer, wherein the second mixture and the optical brightening agent are mixed in the third static mixer at a pressure level of 200 to 1,000 kPa to form a third mixture which is supplied to a fourth pipe which flows into a fourth static mixer;

supplying water to the fourth pipe which flows into the fourth static mixer, wherein the third mixture and the water are mixed in the fourth static mixer at a pressure level of 200 to 1,000 kPa to form a fourth mixture which is supplied to a fifth pipe which flows into a dynamic mixer having a rotor and a stator;

wherein the fourth mixture is mixed in the dynamic mixer, and supplied through an outlet to at least one fifth pressure screen having a perforated screen with perforations of approximately 65-300 micrometers in size; and wherein the fourth mixture after passing through the at least one fifth pressure screen is supplied to a coating station for application to a paper or board web.

13. The method of claim 12 further comprising passing a fourth pigment through a fifth pressure screen into the second pipe which flows in to the second static mixer, and wherein the fourth pigment and the third pigment are mixed in the second static mixer to form the second mixture.

14. The method of claim 12 wherein the fourth mixture after passing through the at least one pressure screen is supplied first to a machine container from which it is pumped to a deaerating device connected to a source of vacuum of approximately 0.5-50 kPa, and following the deaerating device pumped to a further pressure screen, and then supplied to the coating station.

* * * * *